United States Patent [19]

Budimirov

[11] 4,158,899

[45] Jun. 26, 1979

[54] SEAT

[75] Inventor: Bogdan Budimirov, Munich, Fed. Rep. of Germany

[73] Assignee: Budimirov GmbH, Munich, Fed. Rep. of Germany

[21] Appl. No.: 843,319

[22] Filed: Oct. 18, 1977

[30] Foreign Application Priority Data

Oct. 19, 1976 [DE] Fed. Rep. of Germany ..... 2647168

[51] Int. Cl.[2] ..... A47C 23/00; A47C 7/02

[52] U.S. Cl. ..... 5/448; 267/107; 297/455

[58] Field of Search ..... 5/246, 247, 345 R; 267/103–110; 297/452, 453, 455, 456, 458

[56] References Cited

U.S. PATENT DOCUMENTS

| | | | |
|---|---|---|---|
| 100,116 | 2/1870 | Casseday | 267/109 |
| 219,589 | 9/1879 | Mayo | 297/455 X |
| 270,093 | 1/1883 | Miller | 267/110 |
| 2,530,924 | 11/1950 | Turner | 297/455 X |
| 2,804,129 | 8/1957 | Propst | 267/103 |
| 3,399,883 | 9/1968 | McKey | 267/103 X |

FOREIGN PATENT DOCUMENTS

| | | | |
|---|---|---|---|
| 183851 | 5/1963 | Sweden | 297/452 |
| 2587 of | 1905 | United Kingdom | 267/103 |
| 22834 | 3/1962 | Yugoslavia | 5/345 R |

*Primary Examiner*—James C. Mitchell
*Attorney, Agent, or Firm*—Frailey & Ratner

[57] ABSTRACT

The invention relates to a seat having a seat portion that is subdivided by slots to provide resilient individual supporting elements, and wherein the seat portion has a width which exceeds the span of the support for the seat portion.

The seat thereby provides a maximum sitting comfort by the superior elasticity of its seat portion, the elasticity extending even into the support for the seat portion.

6 Claims, 4 Drawing Figures

SEAT

This invention relates to a seat.

A known seat composed of a plurality of individual resilient supporting strips mounted on a chair frame, is disclosed in Yugoslav Patent Specification No. 22834. The seat being formed substantially rectangular and having a width corresponding to the span of the strips. The strips extend parallel to the front and rear edges of the seat and are secured to cross-members of the chair frame along unslotted border zones of the seat at its two other edges towards which the strips are bent at substantially right angle. The slots extend between the border zones with interruptions of equal length at the mid-point of the seat to produce an unslotted strip extending between the front edge and the rear edge of the seat at the mid-point of the seat. In addition, the known chair is provided with a back-rest which is integral with the seat and formed alike.

Seats of this construction are superior to so-called "shell seats", since the slots provide resilient individual supporting strips which improve the comfort of sitting. Where large-surface seats are involved, that is to say seats in which the dimensions of the seating area exceed the normal dimensions of the seating area of a chair or a stool, and the dimensions of which permit the seat to serve as a reclining part or even as a bed as well, it has been found that, while the load bearing capacity is fully maintained, the seat or reclining area has fewer resilient sections. The seat thus comprises harder and softer areas providing corresponding variable sitting comfort, since only some of the seating areas of the seat are utilized. Such variable sensation of sitting comfort can easily occur where smaller seats are involved. Here, depending upon individual sitting habits, the harder border areas rather than the whole seat are utilized for sitting, resulting in general discomfort. In the case of larger surfaces suitable for reclining, these disadvantages may also lead to a damaged posture owing to the exposure of the spine to variable stress in the horizontal position.

It is thus an object of the invention to provide a seat of the type hereinbefore described which improves the optimum surface distribution over the peripheries of the individual supporting elements. This ensures a more uniform distribution of resilience across the seat in general so that the comfort of sitting obtained when a smaller section of the seat is used equals that obtained when a larger section of the seat or substantially the whole area of the seat is used.

According to the invention, there is provided a seat having a seat portion that is subdivided by slots to provide resilient individual supporting elements, and wherein the seat portion has a width which exceeds the span of the support of the seat portion.

In this way, the resilience of the seat thus extends into its support portions with the result that the performance decisive for comfortable sitting when only a section of the seat portion is used, is dependent practically exclusively upon the normal elastic properties inherent in the material used for the seat. The choice of materials available for the seat is thus limited only by the requirement of the presence of a certain degree of inherent elasticity. At the same time, the elastic performance of the seat can be controlled by specific arrangement of the slots, that is to say the seat in general may be of a harder or softer construction resulting in advantages particularly in cases where a seat of larger dimensions is suitable for use as a reclining seat.

An embodiment of the invention will be described hereinafter with reference to the accompanying drawings wherein.

Figure 1:
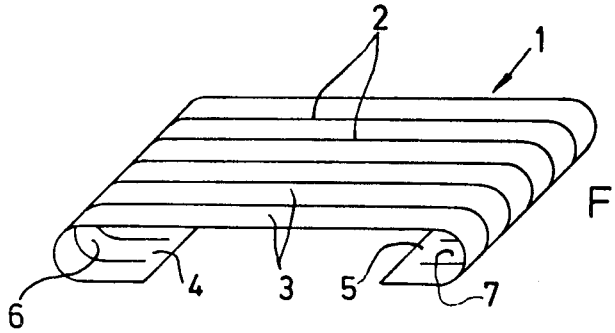
FIG. 1 shows a perspective view of a seat according to a first embodiment of the invention.

The seat 1 shown in FIG. 1 is composed of a substantially rectangular upper seating portion delimited in its longitudinal extent by folded-over lateral end portions 6 and 7.

The seat 1 is subdivided by parallel longitudinally extending slots 2 into individually resilient substantially uniform, supporting strips 3.

The slots 2 terminate in unslotted border zones 4 and 5 formed at the free edges of folded-over end portions 6 and 7 respectively.

Figure 4:
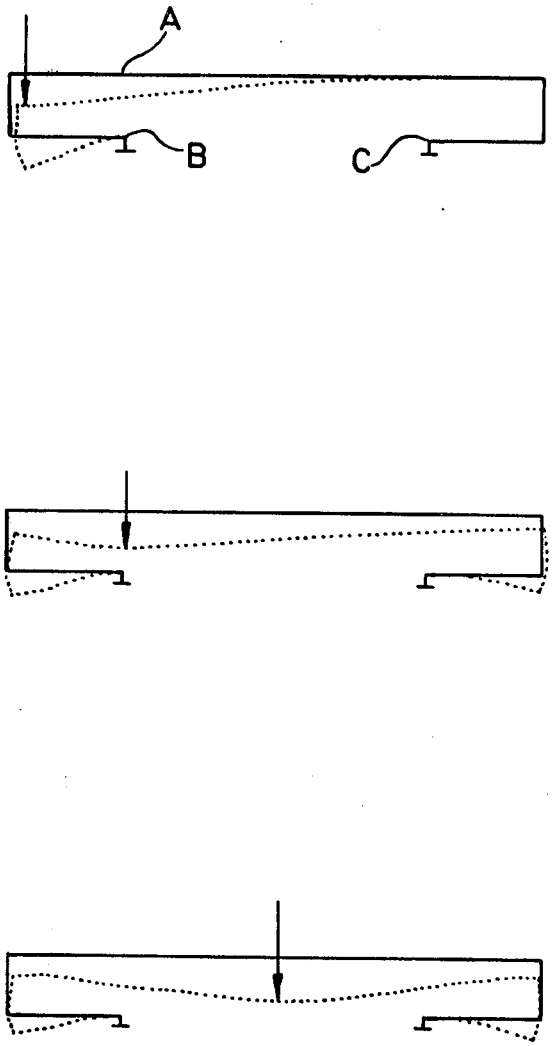
FIG. 4 shows diagrams illustrating the effect of the application of a load to the seat at various positions.

The portions 6 and 7 form respective support members for the seat 1. The span of these support members which is the spacing between the border zones 4 and 5 being less than the width of the seating portion of seat 1. Depending upon the material used, the folded-over end portions 6 and 7 may be bent at an angle, curved, arcuate or polygonal as shown in FIG. 4. It is merely of importance that the said span of the support members formed by the folded-over end portions 6 and 7 be smaller than the width of the seat portion of the seat 1, the difference determining the degree of elasticity of the seat.

FIG. 4 is illustrative of the performance of an embodiment of a seat according to the invention upon application of a load, indicated by an arrow, to the seat at various positions. When the load is applied to the seat A supported at points B and C as shown in the upper diagram of FIG. 4, the seat A undergoes a correspondingly limited deformation assisted solely by the support B close to the point of application of the load. As illustrated in the intermediate and lower diagrams of FIG. 4, the deformation increases with increasing utilization of the other support C and increasing shifting of the point of application to the centre of the seat A. It is thus ensured that the seat affords a sensation of constant sitting comfort, since the supporting strips 3 perform in the manner of springs imparting a constant springiness between the two supports B and C.

The shape of the upper seating portion may be of any shape providing that the aforementioned criterion between support member span and the seating portion width is met.

Figure 2:
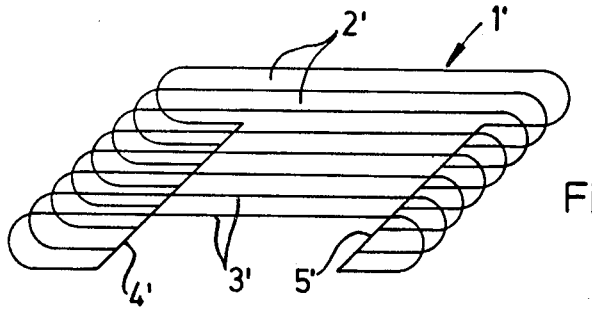
FIG. 2 shows a modified form of the seat according to FIG. 1 modified with respect to the slots.
Figure 3:
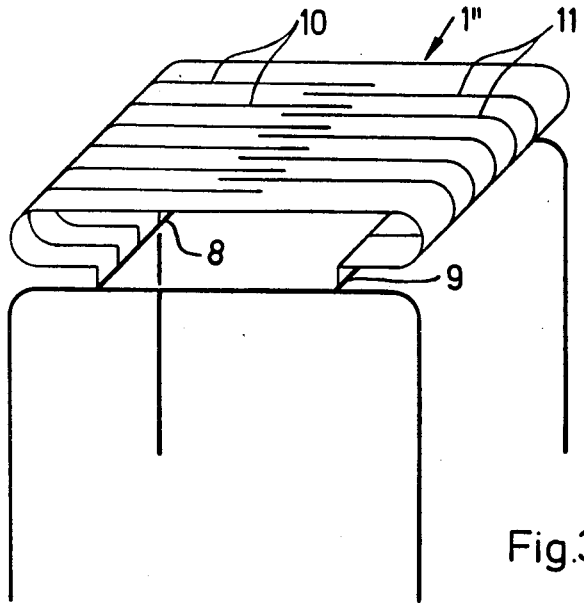
FIG. 3 shows a seat according to another embodiment of the invention suitable for mounting on a stool.

The seat shown in FIG. 1 is constructed as a self-supporting piece of furniture. However, the construction of the seat 1' shown in FIG. 2, is suitable for mounting in a furniture frame. In this case, individual continuous slots 2' extend to free edges 4' and 5' of the seat 1', to form resilient supporting strips 3'. As shown in FIG. 3, the edges 4' and 5' may thus be secured to cross-members 8 and 9 of the frame of, for example, a chair or a stool. In this example, the size of the seat 1' and of the individual strips 3' are determining factors in forming a judgement on the advisability of covering the seat with padding or upholstery.

The seat 1″ shown in FIG. 3 is a further alternative embodiment of the invention wherein slots 10 are provided, running from one free end of the seat 1″ to terminate substantially at the mid-point of the upper seating portion, while similar slots 11 run from the other free end of seat 1″ to terminate substantially at said mid-point. The slots 10 and 11 are positioned such that they intersect or overlap at the mid-point of the upper seating portion such that the ends of the slots are disposed at the apices of an imaginary zig-zag connecting line. Slots of this construction may also be incorporated in the seats 1 and 1′ shown in FIGS. 1 and 2. Moreover, the width of the slots may exceed the width of the supporting strips 3 or 3′ of FIGS. 1 and 2, or the strips of the FIG. 3 embodiment formed by the slots 10 and 11.

What I claim is:

1. A seat comprising a seat portion of a substantially quadrangular configuration with two folded-over end portions at a first of two opposing edges of its upper vertical projection, the folded-over end portions forming a support for the seat portion having a spanning distance less than the distance between said first two opposing edges, the spanning distance being measured between the free edges of said folded-over end portions and underlying the load-bearing surface of the seat portion, and the seat portion being subdivided by a series of spaced alternately arranged first and second slots extending substantially in parallel to a second of two other opposing edges of the seat portion to provide substantially equally sized resilient load-bearing portions, the first slots beginning at said one folded-over end portion and the second slots beginning at the other opposing folded-over end portion, the first and second slots each terminating in an overlapping formation substantially in the middle of the seat portion.

2. A seat according to claim 1 wherein the first and the second slots terminate in the corners of an imaginery zig-zag connecting line.

3. A seat according to claim 1 wherein the first and the second slots each extend at their beginning to the free edge of the respective folded-over end portion.

4. A seat according to claim 1 wherein the first and the second slots each extend short of the free edge of the respective folded-over end portion to provide an unslotted border at the beginning of the slots.

5. A seat according to claim 1 wherein the seat portion is secured by its folded-over end portions to a frame of a furniture.

6. A seat according to claim 1 wherein the seat portion is covered with an upholstery.

* * * * *